United States Patent [19]

Metcalfe et al.

[11] 4,134,762

[45] Jan. 16, 1979

[54] SELECTIVE PHOTOCONDUCTOR-BINDER COATING OF ABSORBENT SURFACES

[75] Inventors: Kenneth A. Metcalfe, Lockleys; Alwyn S. Clements, Largs Bay, both of Australia

[73] Assignee: The Commonwealth of Australia, Canberra, Australia

[21] Appl. No.: 806,503

[22] Filed: Jun. 14, 1977

[30] Foreign Application Priority Data

Jul. 2, 1976 [AU] Australia ..... 6513/76

[51] Int. Cl.[2] ..... G03G 5/087; G03G 5/082

[52] U.S. Cl. ..... 96/1.5 R; 96/1.8

[58] Field of Search ..... 96/1.5, 1.8

[56] References Cited

U.S. PATENT DOCUMENTS

| | | | |
|---|---|---|---|
| 2,959,481 | 11/1960 | Kulera | 96/1.8 |
| 2,990,279 | 6/1961 | Crumley et al. | 96/1.8 |
| 3,121,006 | 2/1964 | Middleton et al. | 96/1.5 |
| 3,347,670 | 10/1967 | Nelson et al. | 96/1.5 |

*Primary Examiner*—Roland E. Martin, Jr.

*Attorney, Agent, or Firm*—Haseltine, Lake, & Waters

[57] ABSTRACT

The method of coating a pervious fibre sheet with a photoconductor in which the photoconductor, a resin and a solvent for the resin are each selected and combined to have different penetrating power when applied to the pervious sheet whereby the photoconductor has a minimum penetration, the resin has a greater penetration and the solvent has the greater penetration, the components being selected to have an increasing dielectric constant inwards from the surface of the sheet, the resin being hydrophobic and capable of wetting both the photoconductor and the fibre.

6 Claims, 2 Drawing Figures

SELECTIVE PHOTOCONDUCTOR-BINDER COATING OF ABSORBENT SURFACES

FIELD OF THE INVENTION

This invention is concerned with the surface coating of electrophotographic layers containing a photoconductor and a binder required for use in electrophotographic printing and direct photography. The materials on which such coatings are required are generally paper, but film base and glass and metal are also involved. It is required in the art to produce a photoresponsive layer which can be charged, exposed and developed with electrographic developers, and paper coated with such layers are in common daily use in electrostatic copying machines.

BACKGROUND

It is believed generally in the industry that the backing must be "conductive", or must have a conductive substrate, in order that an electrostatic image may be produced, and this precept has delayed the introduction of materials which have not been rendered conductive.

One way in which paper is commonly rendered conductive is to make it hydrophilic which, of course, renders it unsatisfactory in the production of lithographic masters. A feature of paper backings is that the coatings produced on it by the present methods have a peculiar "feel" which is now well known and results in unfavorable comparisions with plain paper.

SUMMARY OF THE INVENTION

It is one object of this invention to render the feel of coated paper similar to plain paper, and it is another object to make it readily usable for lithographic masters. It is a further object of this invention to reduce the weight of the coated paper.

These objects are achieved by controlling the separation of the photoconductive material such as, for instance, zinc oxide, lead iodide, and cadmium sulphide from the binders and solvent during coating and drying, and also by controlling the wetting of the paper sheet by the binder and solvent. Filling the paper with resinous or similar binder generally results in unwanted insulation of the backing and thus prevents selective leakage of the image charge and thus impairs the final result. According to this invention the penetration of the paper by the fixing resins is limited.

For the better understanding of this invention reference may be made to two extremes (a) if the paper is not penetrated by the coating material, then the coating composition is substantially that of the coating material supplied and (b) if the paper absorbs one or more of the pigment, binders or solvents, then separation of the constituents occurs and migration of the constitutents proceeds selectively according to molecular size, specific gravity, evaporation rate and the like as is well known in filtration and in analytical techniques such as paper chromatography.

In the limit we can take the case of vacuum evaporated selenium or sulphur on metal or glass where the coating is continuous and is not heterogeneous. In this case any imperfections which appear in the electrophotographic image relate to the interface and to variations in crystal modifications of the selenium e.g. formation of hexagonal selenium. Similarly, heterogeneous mixtures of pigment, binder and solvent on metal or glass show imperfections which relate to the surface of the backing or to the mode of drying of the coating and not to selective absorption of the coating material by the backing.

At the other extreme a mixture of pigment, dye, polymers, solvents coated on to a very absorbent paper will separate into various components depending on the absorbence of the paper, wettability of the fibers, pore size of the paper, and the like.

We have now shown that to obtain a plain paper feel the coating must follow the contours of the fibers and be rich in pigment or filler at the outer surface, so that binder polymers must be drawn into the paper to serve as an anchor for the pigment. However, if the binder can migrate through the paper to any appreciable extent, its electrical resistivity must be lower than that of the top layer of the coating. Otherwise the binder must be precipitated in the paper fibers before it reaches the back of the paper layer to any extent.

Two solutions to this problem are (a) to use a relatively high dielectric constant binder (relative to that of the photoinsulator used) and precipitate it on or in the fibers of the paper or (b) to use a pair of binders one of which, the more conductive, will migrate further than the other more insulating one.

According to this invention, these are selected to be hydrophobic, and thus the upper surface of the paper will be protected against moisture or damage under tropical or humid conditions, whereas the lower layer of the paper can absorb some moisture and in any case will differentially be more conductive than the upper layers, with the most insulating layer at the upper surface, a condition which ensures effective action of the photoconductive paper.

BRIEF DESCRIPTION OF THE DRAWINGS

In the following description reference will be made to the accompanying drawings which are schematic only and in which.

DETAILED DESCRIPTION

Figure 1:
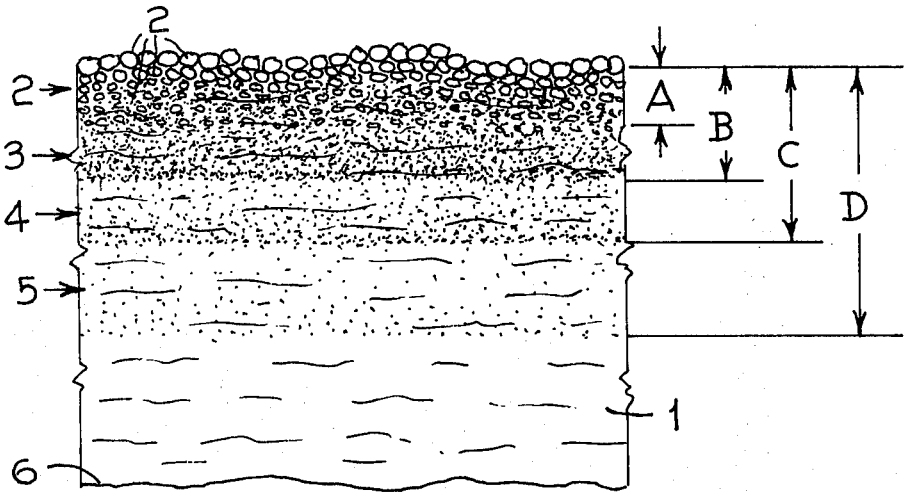
FIG. 1 is an enlarged sectional view of a typical coating on paper as carried out according to our invention and FIG. 2 is an electrical counterpart showing the effects achieved

In the illustration the paper, which is free of filler which would prevent penetration of the coating material into the surface, is designated 1, the photoconductor being designated 2.

The resin and solvent are designated 3, 4 and 5 respectively, two resins being used in the embodiment illustrated. the back of the sheet being designated 6.

The penetrations of the photoconductor is designated by A, the penetration of the first resin being shown by B, the penetration of the second resin by C, and the penetration of the solvent by D.

Thus, according to this invention, the medium which contains the photoconductive particles is so selected that the carrier and fixing medium for the photoconductor particles is such that the resins and solvents, which comprise this fixing medium migrate into the surface of the paper which is selected to be relatively free of surface filler and is sufficiently porous, carrying the smaller photoconductive particles into the surface, but depositing the larger particles on or at the surface, the solvents and resin being so selected that the resistivity then grades from the surface where it is highest to a lower resistivity within the sheet.

The predominance of the larger photoconductor particles, which in the dark have a dielectric constant of about 2 remains at the top surface area but lower in the support medium the dielectric constant is of the order of perhaps 4 or 5 due to the presence of the resin or resins, so that there is a gradient in the coating itself which decreases in electrical resistivity inwards. This also ensures that the sheet is generally less moisture absorbent excepting perhaps at the lower surface where the resin and solvent has not penetrated.

Figure 2:
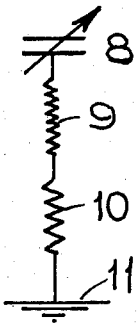

In practice, the layer applied to the sheet, which carries photoconductor particles, includes a high resistance resin and a more conductive resin, the latter selected to form a substrate, due to migration characteristics, which connects into the sheet. The electrical counterpart shown in FIG. 2 comprises a condenser 8 at the surface representing the variable charge holding capacity of the photoconductor, as its resistance varies with the application of light a resistance 9 connecting to the condenser to represent the high resistivity resin, a further series resistance 10 representing the more conductive resin, the support medium below this being represented by ground 11 in that particularly in the case of paper, atmosphere moisture has been absorbed to further lower resistivity.

The result is a gradient from a high variable resistivity at the surface to a more conductive surface toward the rear.

This gradient can be built into the layer which itself can be formed on the support, the important feature being that the increasing conductivity inwards is obtained.

The resin binder used must be able to wet the photoconductor to form a coating on the particles thereof during grinding, and must be capable of wetting the fibers of the paper in the presence of the solvent for the resin.

We have found that not only does the surface of the coated paper sheet simulate the general texture of the sheet due to a layer being formed by penetration of the liquid material into the sheet to carry into the sheet at least some of the photoconductor, but the photoconductor is better bonded to the sheet by being locked to the fibers of the sheet and importantly the resistivity gradient is such that while the surface has a high electrical resistivity in the dark, the internal areas of the sheet have an increasing conductivity.

The invention can be put into effect by knife coating or other methods but, because of the selection, absorption will produce the required surface, and if desired the coating can be applied by an electrical field and in that case the liquid components and resins can be selected to be aided in penetration by the field.

In order to satisfy ourselves in relation to the principles involved we conducted the following tests.

TEST 1

To show the chromatographic separation of the resin binder in a mixture of solvents from the zinc oxide - resin paint coating mixture, which was used to coat bond paper stock to make an electrophotographic paper, it was necessary to dye the coating mixture with auramine to make the separation visible.

Details of the coating paint mixture were as follows:— 50 grams of PVB Mowital B60H grade resin was dissolved in 800 mls of methyl ethyl ketone and 200 mls of methyl alcohol and added to 500 grams of electrophotographic quality zinc oxide and ball milled for 24 hours.

This mixture was further diluted with 200 mls of chlorothene after milling.

An aliquot of 25 mls was taken and diluted with 25 mls of methyl ethyl ketone, into which was dissolved 5 mls of auramine (1% solution in methyl alcohol).

To a stack of filter papers (held together with a brass open ended cylinder, for convenience, with a 2 K gram weight) a small quantity of the dyed paint mix was applied in the center and allowed to penetrate the filter papers (No. 4 Whatman papers designated as "open texture, fast, not recommended for fine precipitates").

On drying the filter papers were stapled together and each paper examined for penetration and separation. It was found that at sheet 7 level a very small amount of zinc oxide mixture had penetrated from the paper above but the resin binder-dye-solvent had spread laterally away from the zinc oxide area.

TEST 2

To show that the material, which in some cases had penetrated right through the bond paper when it was dip coated with a solvent resin - zinc oxide mixture, was either free from zinc oxide or contained zinc oxide, the paper surface was charged with a high voltage discharge from a corona source, exposed to a light image and developed in a hydrocarbon liquid with blue particles as a marking medium.

The sample so produced showed no visible image over most of the area, although where the zinc oxide - mixture had coated both sides of the paper at the edge, an image had been made visible by the developer.

TEST 3

To further show the penetration and chromatographic separation effect of coating one side of bond paper with a PVB (Mowital B60H) resin - zinc oxide coating mixture, a small quantity of a 4% water solution of methylene blue was applied to the uncoated side of the bond paper and allowed to penetrate and then dry.

A drop of a 1% solution of Rose Bengal in methyl alcohol was then applied to the zinc oxide coated side. After drying, the paper was torn to expose the evidence of penetration of the dye.

The torn edge showed a definite barrier caused by the penetration of the PVB resin from the zinc oxide coating.

TEST 4

A photomicrograph of a section of coated paper similar to the previous examples when examined under a magnification of X75 indicated clearly the zinc oxide - resin coating on the surface of the bond paper with some penetration of the fibres by the coating material. It closely indicated also that the coating followed clearly the contours of the paper, and varying depth of penetration was evident owing to the nature of the paper stock.

To obtain the photomicrograph the sample was mounted in a thermo setting resin and the section polished. The following examples illustrate the ways in which the process may be carried out:

EXAMPLE 1

The following components are milled together in a ball mill to form a coating composition:

| | |
|---|---|
| zinc oxide | 500 grams |
| styrene - butadiene copolymer (Buton 100) | 50 grams |
| alkyd resin, short oil modified | 250 grams |
| mineral turpentine | 500 millilitres |
| Aromatic hydrocarbon (Esso 100) | 500 millilitres |

The ball milled coating material is applied to a bond type paper or an art paper, which was sufficiently porous to allow penetration by the resin and solvent, by dip coating or knife coating. The pigment to binder ratio may be varied from 3:1 through to 7:1 and the Buton; short oil alkyd ratio from 5:1 to 50:1.

The above composition may be dye sensitized as required for modification of spectral response or speed. A typical dye addition to 500 grams of zinc oxide is as follows:

| | |
|---|---|
| Erioglaucine | 0.09 grams |
| Sodium fluorescein | 0.05 grams |
| Erythrosin B | 0.05 grams |
| Blancol SS optical whitener | 0.01 grams |

In the above situation the Esso 100 solvent is absorbed into the paper first, causing some deposition of the polymers by the remaining solvent of lower solubility which is the mineral turpentine which then itself diffuses into the paper to finally precipitate the polymers, with a preponderance of short oil alkyd resin at the top and Buton 100 below it.

Under quiescent conditions, there is aggregation of the pigmented lower solubility polymer at the top surface, with high pigment to polymer ratio. At greater depths in the coating layer, the aggregates of polymer contain less pigment and more of the higher solubility polymer, co-precipitated. At the interface between the coating deposit and the paper backing, a zone is formed in which the further migrating polymer is finally precipitated. The depth of the zone depends on the absorbence of the paper, presence of any other barriers including filling of the paper, and the solubility of the polymers. A complicating factor is that as the solvents evaporate rapidly, the coating layer is agitated by thermal currents which can homogenize the layer to some extent but also form Benard cells which are accompanied by some macro-segregation of heterogeneous components.

EXAMPLE 2

In example 1, the Buton 100 polymer is replaced by a silicone resin DC804, 60% N.V.M.

EXAMPLE 3

In example 1, the Buton 100 polymer is replaced by a hydrocarbon resin Picco 6140-3.

EXAMPLE 4

In example 1, the Buton 100 polymer is replaced by an acrylic polymer Lucite 2046.

EXAMPLE 5

A coating composition is prepared which contains the following:

| | |
|---|---|
| Zinc oxide, | 500 grams |
| Polyvinylbutyral polymer P.V.B. B60H, (Mowital) | 50 grams |

-continued

| | |
|---|---|
| Short oil alkyd resin, 4501/50 | 25 grams |

The P.V.B. B60H is taken up in acetone; the short oil alkyd resin is let down with 50 milliliters of xylol. The binder polymers are added to the zinc oxide and the whole is ball milled. Dye sensitizers similar to those listed in Example 1 are added. The pigment-binder ratio can be from 3:1 to 24:1.

EXAMPLE 6

In example 5, the PVB polymer B60H is replaced by B70H or B20H polyvinyl acetal-butyral resins.

EXAMPLE 7

In example 5, the short oil alkyd resin is replaced by an acrylic modified alkyd such as Lustrasol AU180/50 an acrylic modified (short oil) alkyd resin 50% N.V.M.

EXAMPLE 8

In example 5, the PVB60H is replaced by Lucite 2046, an acrylic polymer resin, DuPont, U.S.A. and the alkyd resin by a vinyl toluene acrylic copolymer, or chlorosulphonated polyethylene, polyvinyl chloride - acetate copolymers, malamine-formaldehyde resins, polyester resins, terpene resins, chlorinated polyphenyls aryl sulphonamide - formaldehyde resins.

LIST OF MATERIALS REFERRED TO IN THE EXAMPLES

Buton 100 is a styrene-butadiene copolymer manufactured by Esso Australia Ltd. It is an almost colourless oil having a viscosity of about 3,500 poise and a molecular weight of from 2,000 to 3,000. The structure given by the manufacturer is:

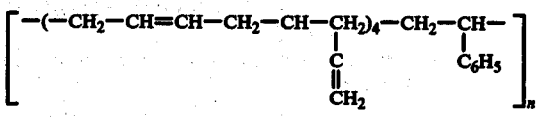

Zinc Oxide white pigment 99.99% ZnO manufactured by Durham-Lysaght Australia Pty. Ltd., mean particle diameter 0.05 microns.

Alkyd Resin short oil, modified, e.g. 2204/50 Iso-Kemisol a linseed oil isophthalic alkyd, 50% N.V.M. manufactured by Kemrez Chemicals Australia, Victoria.

Mineral Turpentine a white spirits petroleum hydrocarbon comprising a mixture of paraffins, cycloparaffins, and aromatic hydrocarbons with a boiling range of 149°C–196° C with a mixed aniline point 46° C (A.S.T.M. D611) manufactured by Shell Chemicals Aust. Pty. Ltd.

Erioglaucine is an oxidation-reduction indicator dyestuff. C.I. 42045 (also known as Alphazurine G or disulphine Blue V)

Sodium Fluorescein (Uranin):

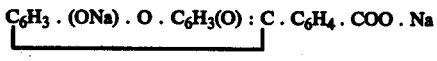

is an adsorption indicator dyestuff C.I. 45350.

Erthrosin B (tetra-iodo-fluorescein) is an adsorption indicator dyestuff. C.I. 45430. all available from B.D.H. (Aust.) Pty. Ltd.

Blancol SS is a trade mark for an optical whitening agent Manufactured by General Aniline & Film Corp. U.S.A.

Silicone Resin DC 804 is a silicone resin comprising 60% solid resin content with Toluene as solvent.

| | |
|---|---|
| Specific Gravity at 25° C | 1.06. |
| Viscosity at 25° C | 20–40 centipoise |

Manufactured by Dow Corning Corporation U.S.A.

Picco 6140-3 is a petroleum hydrocarbon resin soluble in aliphatic solvents. Other properties include fast solvent release, controllable viscosity and alkyd compatability. Manufactured by Pennsylvania Industrial Chemical Corp. U.S.A.

Lucite 2046 is a 50/50 copolymer of n-butyl/iso-butyl methacrylate, a white granular solid. Viscosity, (40.5% Solution in Toluene at 25° C, by No. 15 Parlin Cup) 40–70 secs. Manufactured by DuPont de Nemours & Co. (Inc.) U.S.A.

P.V.B. B60H Mowital is a polyvinyl acetal-butyral resin manufactured by Hoechst. A white powder readily soluble in alcohols and glycol ethers and comprising 76–78% acetal, 1% acetate (approx.) and 18–21% alcohol.

4501/50 "Iso-jordosol" is a pure drying short oil alkyd resin with 50% N.V.M. specific gravity 0.99–1.00 Oil length 40%, safflower, oil type, Volatile Xylol. Manufactured by Jordon Chemicals Aust.

5. Lustrasol AU 180/50 is an acrylic modified alkyd resin, 50% N.V.M. specific gravity 0.990; Acid No. (solution), 4-8; Volatile, Xylol. Manufactured by A.C. Hatrick, Australia.

Methyl ethyl ketone $CH_3.CO.C_2H_5$
Specific Gravity 0.81
Boiling Range 79° C–81° C
Maximum Acidity 0.003%

Chlorothene — Trade Mark for industrial organic solvent 1,1,1 - trichloroethane (inhibited)

Methyl alcohol — $CH_3{\cdot}OH$ Specific Gravity 0.80, boiling point 64.7° C

Methylene Blue — An oxidation-reduction indicator dyestuff, soluble in water & alcohol. C.I. 52015

Rose Bengal: (tetra-chloro-tetra-iodo-fluorescein) absorption dyestuff C.I. 45440

Auramine:— Yellow dye sol. alc. $H_2O$ ether. $(CH_3)_2{\cdot}N{\cdot}\ C_6H_4(C{:}NH)C_6H_4{\cdot}N(CA_3)_2{\cdot}$ HCl C.I. 41000

Esso 100 — is a hydrocarbon solvent supplied by Esso Chemicals Aust. Ltd. having an aromatic content of 98% and distillation range 159° C–182° C and consisting of methylethylbenzene & trimethylbenzene with lesser amounts of double ring compounds. Esso Chemicals Aust.

Mowital B70H — a polyvinyl acetal-butyral comprising
74–77% acetal
1% acetate approx.
18–21 alcohol Mowital B20H — a polyvinyl acetal-butyral comprising
75–77% acetal
2% acetate
18–21% alcohol

We claim:

1. A sensitized sheet for use in electrophotography in which the sheet is formed of fiber bonded together to be pervious, and a coating on said sheet constituted by a deposit of a photoconductor and two resins applied by milling the photoconductor with a first hydrophobic resin selected from the group consisting of a styrene-butadiene copolymer, a silicon resin, a hydrocarbon resin, an acrylic polymer resin, and a polyvinyl acetal-butyral resin, and a second resin selected from the group consisting of a short oil modified alkyd resin, an acrylic modified alkyd resin, a vinyl toluene acrylic copolymer, a chlorosulphonated polyethylene, a polyvinyl chloride-acetate copolymer, a melamine-formaldehyde resin, a polyester resin, a terpene resin, chlorinated polyphenyls and aryl sulphonamide-formaldehyde resins, said second resin have a higher dielectric constant that the said photoconductor and said first resin, and a solvent for the resins, said photoconductor having a minimum penetration of the sheet, said first hydrophobic resin having a greater penetration of the sheet than the photoconductor, said second resin having a greater penetration than said first resin, said solvent having a greater penetration than both of said resins, whereby said resins have a higher dielectric constant than the dark conditioned photoconductor but lower than said sheet in the area beyond the penetration of said resins, and whereby said resins are bonded to the said photoconductor and said fiber, and the sheet has a progressively increasing dielectric constant from the photoconductor surface to the back of the sheet.

2. A sensitised sheet according to claim 1 wherein the photoconductor is colloidal zinc oxide.

3. A sensitised sheet according to claim 1 wherein the sheet is formed of cellulosic fibres.

4. The method of coating a pervious fiber sheet with a photoconductor which comprises milling a photoconductor with a first resin and a second resin and a solvent for said resins, each resin being selected to have different penetrating power when applied to the pervious sheet, said photoconductor being selected to have the minimum penetration, said resins being selected to have a greater penetration than the photoconductor, and said solvent being selected to have a greater penetration than said resins, said first resin having a higher dielectric constant than the dark conditioned photoconductor but lower than said sheet in the area beyond the penetration of said first resin, said first resin being hydrophobic and selected to wet the said photoconductor and said fiber, said first resin being selected from the group consisting of a styrene-butadiene copolymer, a silicon resin, a hydrocarbon resin, an acrylic polymer resin, and a polyvinyl acetal-butyral resin, said second resin being selected to have a greater penetration of the sheet than the first resin but less than said solvent, said second resin being selected to have a higher dielectric constant than said first resin, said second resin being selected from the group consisting of a short oil modified alkyd resin, an acrylic modified slkyd resin, a vinyl toluene acrylic copolymer, a chlorosulphonated polyethylene, a polyvinyl chloride-acetate copolymer, a melamine-formaldehyde resin, a polyester resin, a terpene resin, chlorinated polyphenyls or aryl sulphonamide-formaldehyde resins, applying said coating to said sheet, allowing migration of at least said solvent and said resins into said sheet, and evaporating free solvent from said sheet, whereby to have a dielectric grading increasing inwardly from the photoconductive surface toward the back of the sheet.

5. The method of coating according to claim 4 wherein the photoconductor is colloidal zinc oxide.

6. The method of coating according to claim 4 wherein the pervious fibre sheet is a cellulosic sheet.

* * * * *